US010003887B2

(12) United States Patent
Linghu et al.

(10) Patent No.: US 10,003,887 B2
(45) Date of Patent: Jun. 19, 2018

(54) MINIATURE SOUND GENERATOR

(71) Applicants: Ronglin Linghu, Shenzhen (CN); Bo Xiao, Shenzhen (CN)

(72) Inventors: Ronglin Linghu, Shenzhen (CN); Bo Xiao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

(21) Appl. No.: 15/383,031

(22) Filed: Dec. 19, 2016

(65) Prior Publication Data

US 2017/0366900 A1 Dec. 21, 2017

(30) Foreign Application Priority Data

Jun. 15, 2016 (CN) ..... 2016 2 0590955 U

(51) Int. Cl.

| | |
|---|---|
| ***H04R 1/00*** | (2006.01) |
| ***H04R 9/04*** | (2006.01) |
| ***H04R 9/06*** | (2006.01) |
| ***H04R 7/12*** | (2006.01) |

(52) U.S. Cl.

CPC ..... *H04R 9/04* (2013.01); *H04R 7/127* (2013.01); *H04R 9/06* (2013.01); *H04R 2400/11* (2013.01)

(58) Field of Classification Search

CPC . H04R 9/04; H04R 7/127; H04R 9/06; H04R 2400/11

USPC ..... 381/409, 413, 412, 415

See application file for complete search history.

(56) References Cited

U.S. PATENT DOCUMENTS

2014/0056464 A1* 2/2014 Li ..... H04R 9/025 381/400

2015/0016659 A1* 1/2015 Wang ..... H04R 9/06 381/412

* cited by examiner

*Primary Examiner* — Sunita Joshi

(74) *Attorney, Agent, or Firm* — Na Xu; IPro, PLLC

(57) ABSTRACT

A miniature sound generator is disclosed. The miniature sound generator includes a vibration system including a diaphragm and a voice coil arranged below the diaphragm for driving the diaphragm to generate sound, the voice coil having a pair of long axis edges and a pair of short axis edges; a fixing system; and a flexible circuit board elastically supporting the voice coil. The flexible circuit board includes a first fixing part connected with the fixing system, a second fixing part connected to the voice coil, and a plurality of elastic connecting pieces connecting the first fixing part to the second fixing part. The elastic connecting pieces are connected with the long axis edges of the voice coil, and the voice coil is electrically connected with the elastic connecting pieces.

9 Claims, 7 Drawing Sheets

MINIATURE SOUND GENERATOR

FIELD OF THE INVENTION

The invention is related to the technology of electro-acoustic transducers, and especially relates to a miniature sound generator applying a portable mobile electronic product.

DESCRIPTION OF RELATED ART

With development of electronic technology, portable consumer electronic products are increasingly advocated, such as mobile phone, handheld game console, navigation device or multimedia entertainment handset. Such electronic products generally use a miniature sound generator for realizing high-quality music function.

The existing miniature sound generator is provided with two support parts at short axis edges of a voice coil to support the voice coil, and meanwhile, a voice coil lead is arranged at the short axis edges of the voice coil to connect an external circuit; and the support parts are generally a vibrating diaphragm or a flexible circuit board.

However, regardless of the flexible circuit board or the vibrating diaphragm, the voice coil lead is connected with the support part by spot welding, and the support part is only arranged at the short axis edges, which causes that the arm of force of the support part is insufficient, and the voice coil is shaken thus, affecting the performance and sound quality of the miniature sound generator at the low frequency.

Therefore, it is necessary to provide an improved miniature sound generator to overcome above disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
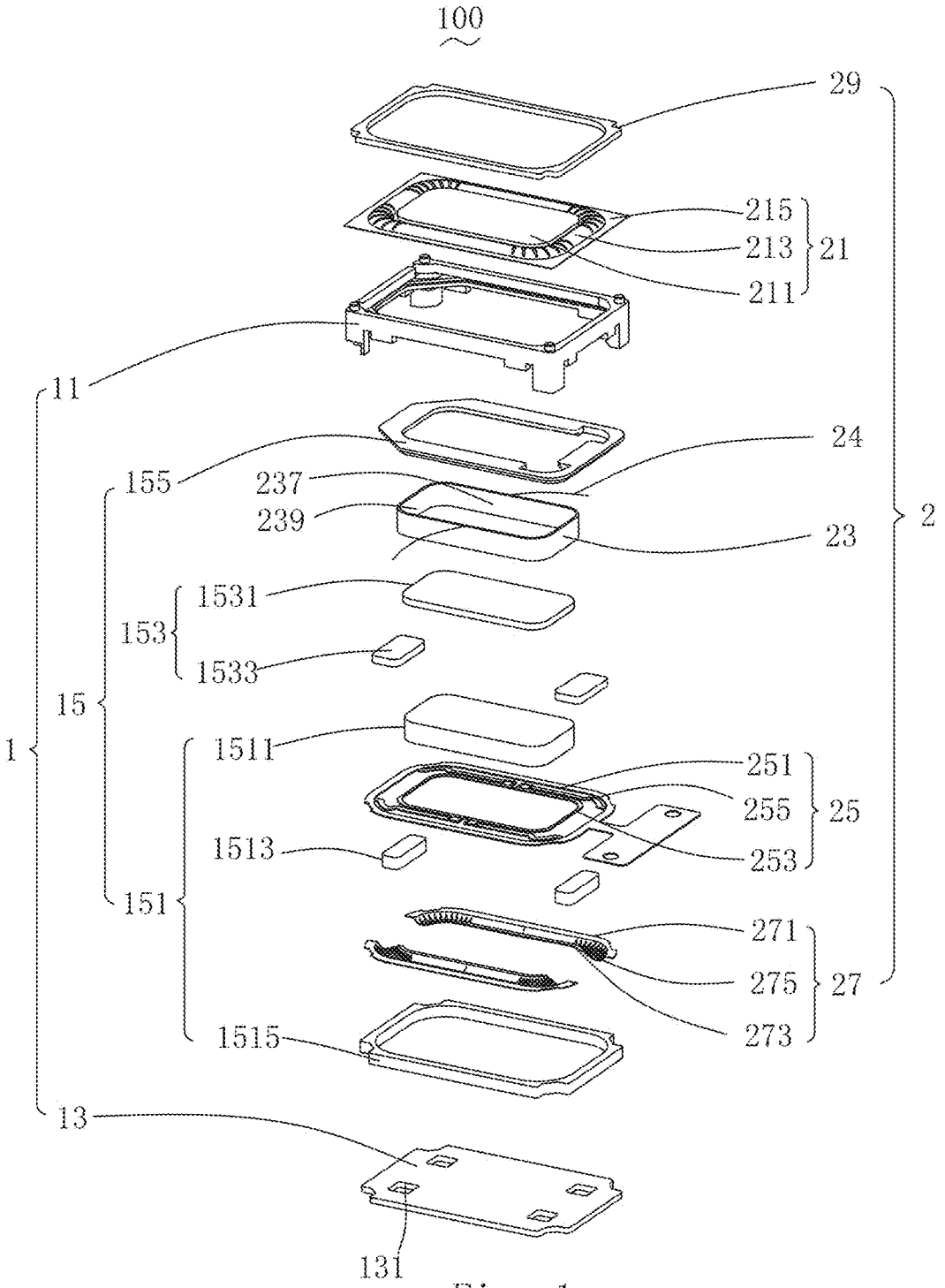
FIG. 1 is an isometric and exploded view of a miniature sound generator in accordance with an exemplary embodiment of the present disclosure.

As shown in FIG. 1, a miniature sound generator 100 in accordance with an exemplary embodiment of the present disclosure, comprises a fixing system 1 and a vibration system 2. The fixing system 1 comprises a frame 11, a magnetic bowl 13 matched with the frame 11 to form an accommodation space and a magnetic circuit system 15 accommodated in the accommodation space for driving the vibration system 2 to vibrate.

The vibration system 2 comprises a diaphragm 21 and a voice coil 23 arranged below the diaphragm 21 and driving the diaphragm 21 to vibrate and sound; and the voice coil 23 comprises a pair of long axis edges 237 arranged oppositely and a pair of short axis edges 239 arranged oppositely, wherein the voice coil 23 is enclosed in the way that the long axis edges 237 connect the short axis edges 239 from end to end. The vibration system 2 further comprises a flexible circuit board 25 elastically supporting the voice coil 23, a voice coil lead 24 electrically connecting the voice coil 23 and the flexible circuit board 25, a vibrating diaphragm 27 elastically supporting the voice coil 23 and arranged at the long axis edges 237, and a cover plate 29 which is hollow and arranged by covering the periphery of the diaphragm 21, wherein the diaphragm 21 is arranged between the frame 11 and the cover plate 29.

The magnetic bowl 13 is flat board in shape and comprises leakage holes 131 penetrating through the magnetic bowl 13 and connecting the accommodation space and an exterior. In the embodiment, the amount of the leakage holes 131 is 4, and the leakage holes are symmetrically arranged around the magnetic bowl 13.

Figure 2:
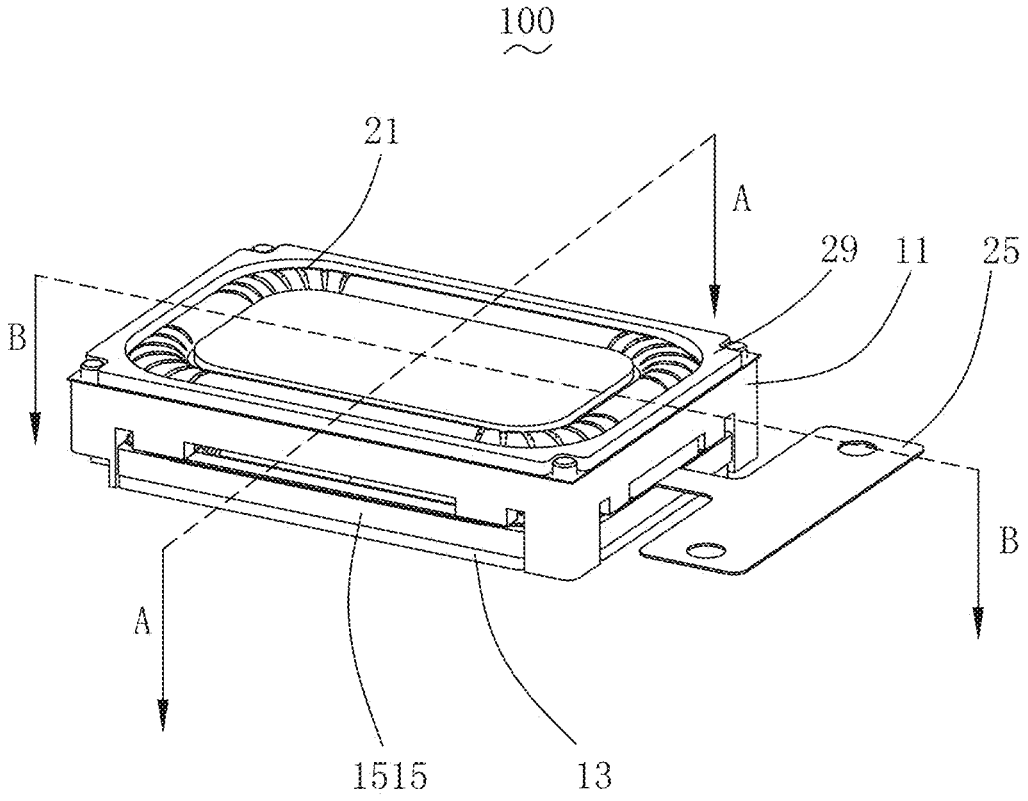
FIG. 2 is an isometric and assembled view of the miniature sound generator in FIG. 1.
Figure 3:
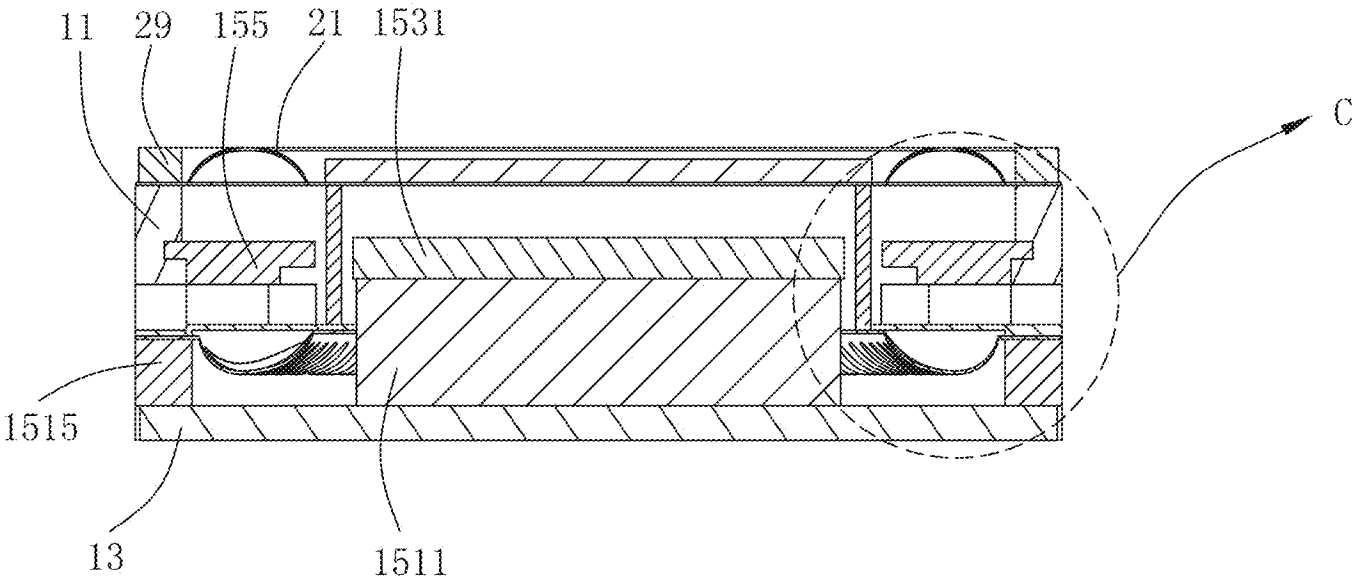
FIG. 3 is a cross-sectional view of the miniature sound generator taken along line A-A in FIG. 2.
Figure 4:
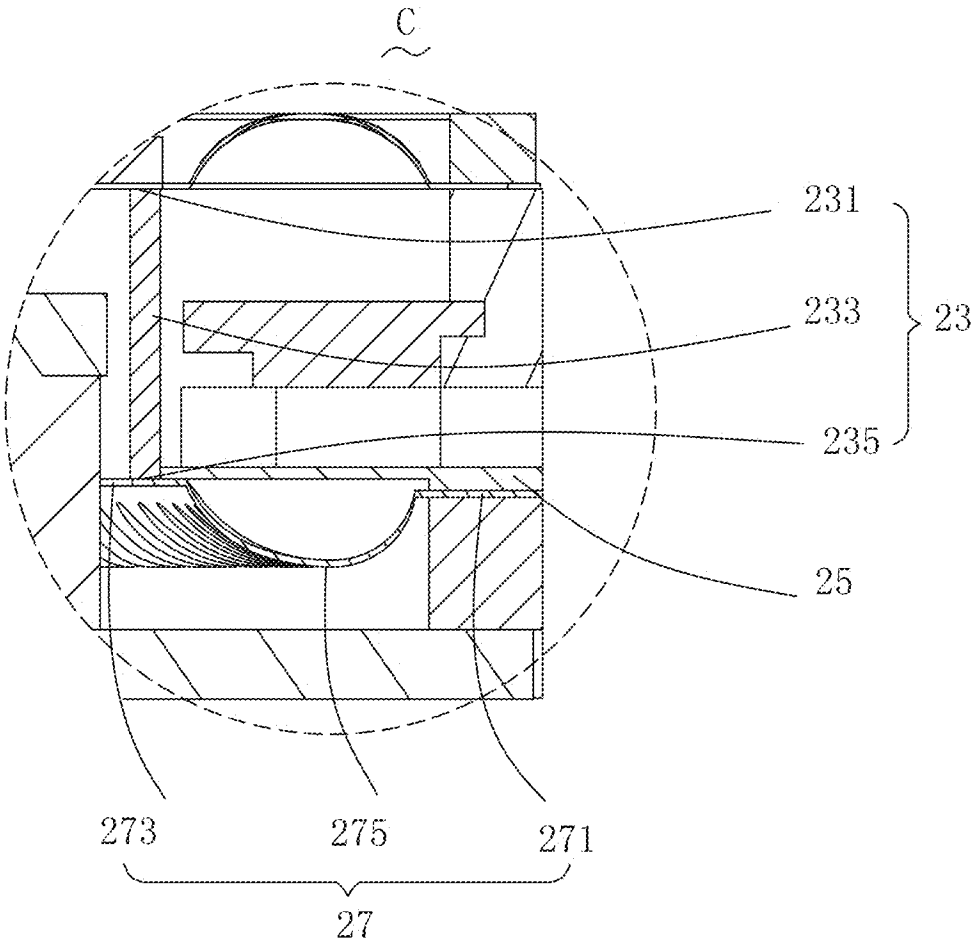
FIG. 4 is an enlarged view of Part C in FIG. 3.
Figure 5:
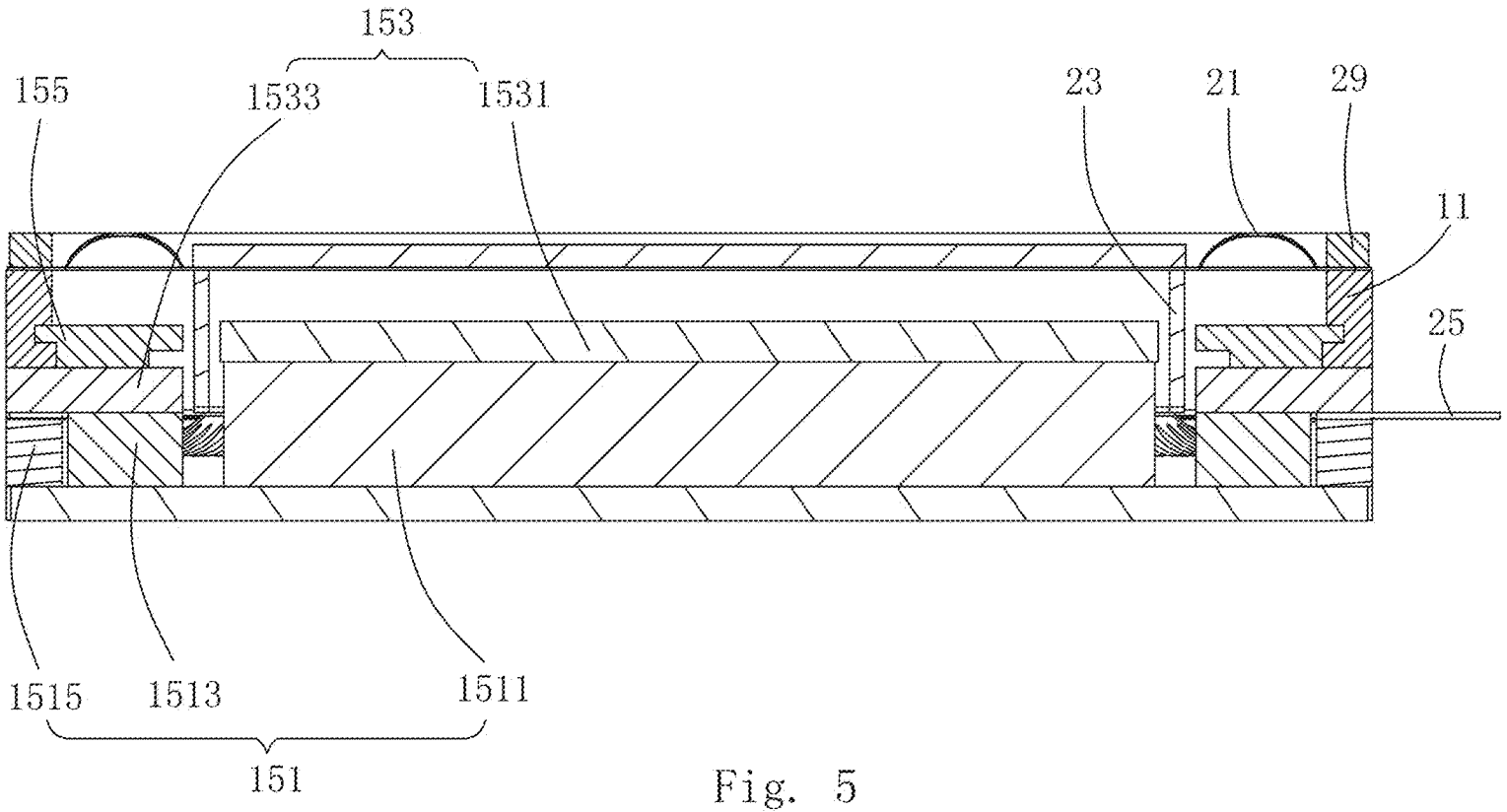
FIG. 5 is a cross-sectional view of the miniature sound generator taken along line B-B in FIG. 2.
Figure 6:
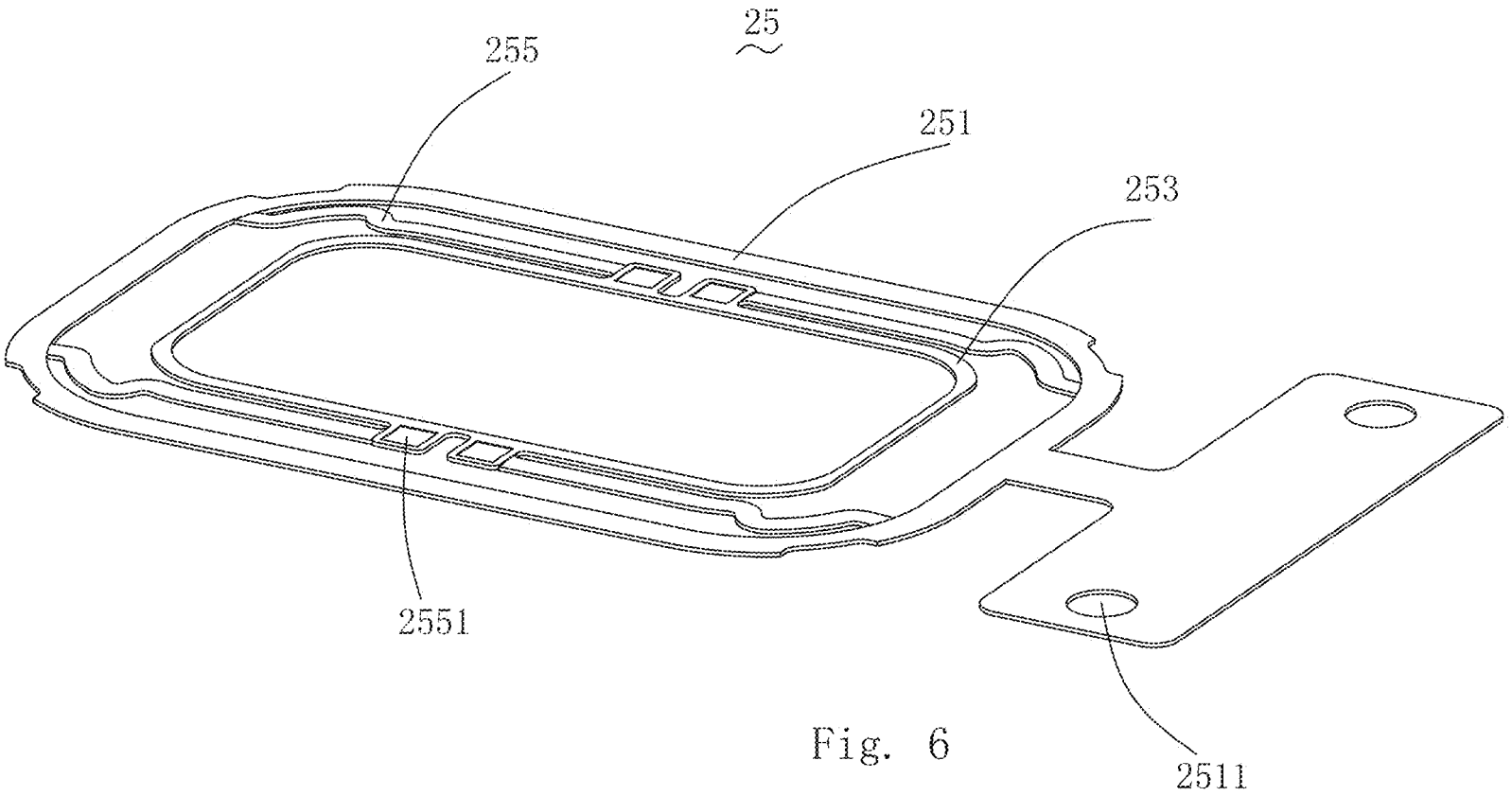
FIG. 6 is an illustration of a flexible circuit board of the miniature sound generator.
Figure 7:
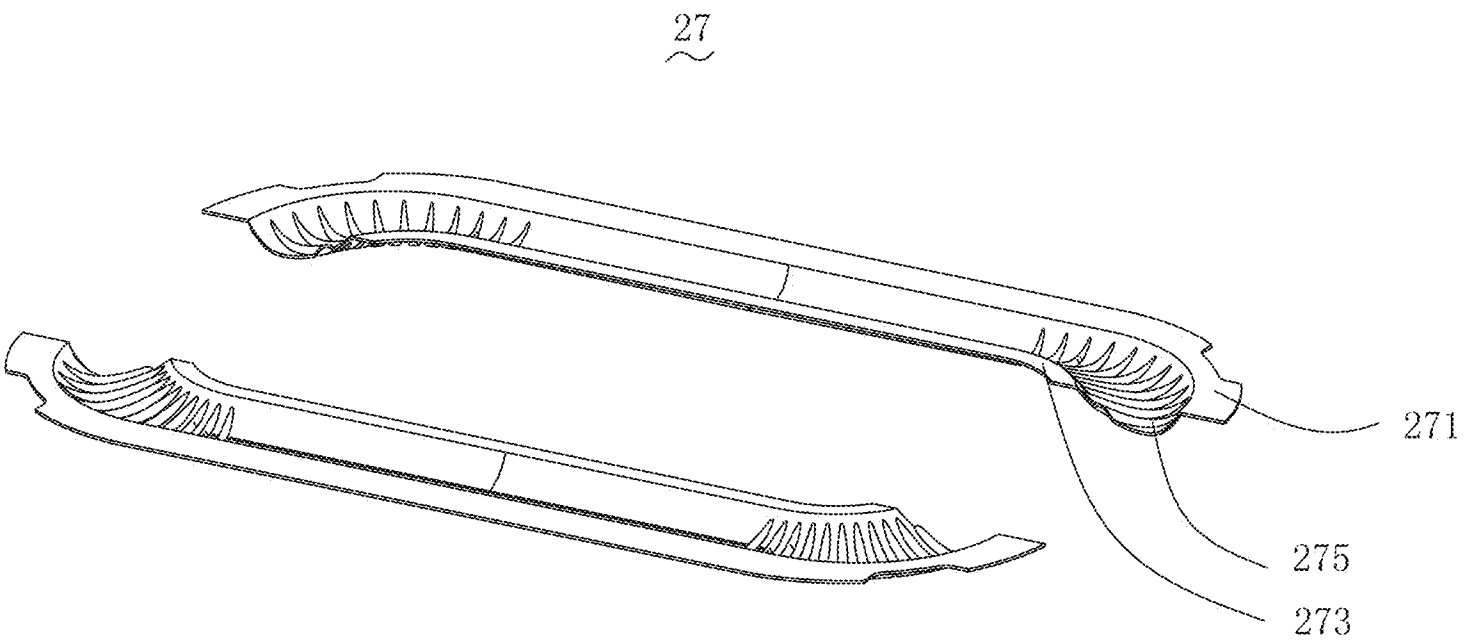
FIG. 7 is an illustration of a diaphragm of the miniature sound generator.

Referring to FIGS. 1, 2 and 5, the magnetic circuit system 15 comprises magnets 151 attached on the magnetic bowl 13, pole plates 153 stacked on the magnet 151, and an upper clamping plate 155 fixed and held on the frame 11 and stacked on the pole plates 153.

The magnet 151 comprises a main magnet 1511, a pair of auxiliary magnets 1513 symmetrically arranged at two sides of the main magnet 1511, and an annular magnetic conductive part 1515 surrounding the main magnet 1511 and the auxiliary magnets 1513. Magnetic gaps are formed between the main magnet 1511 and the auxiliary magnets 1513 also between the main magnet 1511 and the annular magnetic conductive part 1515. The voice coil 23 is inserted into the magnetic gaps, the auxiliary magnets 1513 are arranged at one side of the short axis edges 239 of the voice coil 23, and the voice coil 23 is located between the main magnet 1511 and the auxiliary magnets 1513. The pole plate 153 comprises an auxiliary pole plate 1533 and a main pole plate 1531 stacked on the main magnet 1511, wherein one part of the auxiliary pole plate 1533 is stacked on the auxiliary magnet 1513, and the other part is stacked on the annular magnetic conductive part 1515. Specifically, the upper clamping plate 155 is flat board in shape with a through hole and stacked above the auxiliary pole plate 1533, the main pole plate 1531 is arranged in the through hole of the upper clamping plate 155 and arranged opposite to the diaphragm 21. A surface of the main pole plate 1531 close to the diaphragm 21 is in the same plane with a surface of the upper clamping plate 155 close to the diaphragm 21.

Please refer to FIGS. 1, 3, 4, 6 and 7, the diaphragm 21 comprises a dome 211, a suspension 213 extended from an outer periphery of the dome 211, and a joint part 215 extended from an outer periphery of the suspension. The diaphragm 21 is connected respectively with the voice coil 23 and the frame 11 respectively, specifically, the dome 211 is connected with the voice coil 23, the joint part 215 is connected with the frame 11, and the cover plate 29 is stacked at the joint part 215.

The voice coil 23 is arranged by clamping between the diaphragm 21 and the flexible circuit board 25. The voice coil 23 comprises an upper surface 231 close to the diaphragm 21, a lower surface 235 far away from the upper surface 231, and a side surface 233 connecting the upper surface 231 and the lower surface 235. The upper surface 231 is connected with the dome 211. In the embodiment, the voice coil lead 24 is outgoing from the middle part of the long axis edges 237.

The flexible circuit board 25 comprises a first fixing part 251 fixedly connected with the fixing system 1, a second fixing part 253 fixed with the voice coil 23 and elastic connecting pieces 255 connecting the first fixing part 251 and the second fixing part 253, wherein the number of the elastic connecting pieces 255 are two and both of them have same structure; and the two elastic connecting pieces 255 are arranged at each of the two long axis edges 237 of the voice coil 23 respectively. Specifically, the first fixing part 251 is arranged by clamping between the frame 11 and the annular magnetic conductive part 1515. The second fixing part 253 is connected with the side surface 233 or the lower surface 235 of the voice coil 23. The first fixing part 251 comprises a first bonding plate 2511 connected with an external circuit, each said elastic connecting pieces 255 comprises a second bonding plate 2551 connected with the voice coil lead 24, the electrical connection is realized by welding the voice coil lead 24 and the second bonding plate 2551 or other ways. A conductive path is arranged on the elastic connecting pieces 255 to electrically connect the first bonding plate 2511 and the second bonding plate 2551, and an electric signal is arrived at the first bonding plate 2511 through the second bonding plate 2551 by passing the elastic connecting pieces 255 and then transmitted to the external circuit. In the embodiment, the quantity of the second bonding plate 2551 is four, and every two are symmetrically arranged at the middle part of the long axis edges 237.

The vibrating diaphragm 27 is made of thin film materials, oppositely arranged between the magnetic bowl 13 and the flexible circuit board 25, and symmetrically arranged along the direction of the long axis of the voice coil 23. Gaps corresponding to the short axis edges 239 are formed between the vibrating diaphragms 27; and the vibrating diaphragm 27 comprise a third fixing part 271 connected with the first fixing part 251, a fourth connecting part 273 connected with the second fixing part 253 and a folding part 275 connecting the third fixing part 271 and the fourth connecting part 273.

In other embodiments, when the first fixing part 251 is connected with the side surface 233 of the voice coil 23, the fourth fixing part 273 can be directly connected with the lower surface 235 of the voice coil 23, or connected with the side surface 233 of the voice coil 23, or connected with the first fixing part 251.

In other embodiments, the vibrating diaphragm 27 can also be arranged between the flexible circuit board 25 and the upper clamping plate 155, and at this time, the vibrating diaphragm 27 comprises a third fixing part 271 connected with the voice coil 23 and a folding part 275 connecting the third fixing part 271 and the fourth connecting part 273.

According to the miniature sound generator 100 provided by the present disclosure, the voice coil 23 is supported by arranging the flexible circuit board 25 and the vibrating diaphragm 27, thus, effectively reducing the shaking of the voice coil 23; and meanwhile, the shaking of the voice coil 23 in the direction of its short axis edges 239 is further limited by arranging the elastic connecting pieces 255 and the vibrating diaphragm 27 at the long axis edges 237, thus, increasing the arm of force of shaking of the flexible circuit board 25 and the vibrating diaphragm 27, and improving the sound performance of miniature sound generator 100 at the low frequency.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature sound generator comprising:

a vibration system including a diaphragm and a voice coil arranged below the diaphragm for driving the diaphragm to generate sound, the voice coil having a pair of long axis edges and a pair of short axis edges;

a fixing system;

a flexible circuit board elastically supporting the voice coil, the flexible circuit board including a first fixing part connected with the fixing system, a second fixing part connected to the voice coil, and a plurality of elastic connecting pieces connecting the first fixing part to the second fixing part; wherein the elastic connecting pieces are connected with the long axis edges of the voice coil, and the voice coil is electrically connected with the elastic connecting pieces, the voice coil comprises an upper surface close to the diaphragm, a lower surface far away from the diaphragm, and a side surface connecting the upper surface to the lower surface; and the flexible circuit board is connected with the lower surface or with the side surface.

2. The miniature sound generator as described in claim 1, wherein the vibration system further comprises a voice coil lead connecting to the voice coil and the flexible circuit board, and the elastic connecting pieces comprise a second bonding plate formed by extending to the long axis edges from the second fixing part; and the second bonding plate is connected with the voice coil lead.

3. The miniature sound generator as described in claim 2, wherein the voice coil lead is connected with the second bonding plate by coil outgoing from the middle part of the long axis edges of the voice coil.

4. The miniature sound generator as described in claim 1, wherein the vibration system further comprises a vibrating diaphragm elastically supporting the voice coil; and the vibrating diaphragm is connected with the long axis edges of the voice coil, the vibrating diaphragm comprises a third fixing part connected with the fixing system, a fourth fixing part connected with the voice coil and a folding part connecting the third fixing part and the fourth fixing part.

5. The miniature sound generator as described in claim 1, wherein the vibration system further comprises vibrating diaphragms elastically supporting the voice coil; and the vibrating diaphragms are arranged at the long axis edges of the voice coil, arranged by clamping between the fixing system and the flexible circuit board, the vibrating diaphragms comprise a third fixing part connected with the fixing system, a fourth fixing part connected with the flexible circuit board and a folding part connecting the third fixing part and the fourth fixing part.

6. The miniature sound generator as described in claim 5, wherein the vibrating diaphragms are symmetrically arranged along the direction of the long axis edges, and gaps corresponding to the short axis edges are formed between the vibrating diaphragms.

7. The miniature sound generator as described in claim 1, wherein the fixing system comprises a frame, a magnetic bowl matched with the frame to form an accommodation space and a magnetic circuit system accommodated in the accommodation space and driving the vibration system to vibrate; the magnetic circuit system comprises a magnet attached on the magnetic bowl.

8. The miniature sound generator as described in claim 7, wherein the magnet comprises a main magnet, a pair of auxiliary magnets symmetrically arranged at two sides of the main magnet, and an annular magnetic conductive part surrounding the main magnet and the auxiliary magnets.

9. The miniature sound generator as described in claim 2, wherein the flexible circuit board comprises a first bonding plate formed by extending outward from the first fixing part, and the first bonding plate is connected with an external circuit.

* * * * *